US011332815B2

(12) United States Patent
Hyodo et al.

(10) Patent No.: US 11,332,815 B2
(45) Date of Patent: May 17, 2022

(54) CU—CO—SI-BASED COPPER ALLOY SHEET MATERIAL AND METHOD FOR PRODUCING THE SAME, AND COMPONENT USING THE SHEET MATERIAL

(71) Applicant: DOWA METALTECH CO., LTD., Tokyo (JP)

(72) Inventors: Hiroshi Hyodo, Tokyo (JP); Hisashi Suda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 283 days.

(21) Appl. No.: 16/497,902

(22) PCT Filed: Mar. 27, 2018

(86) PCT No.: PCT/JP2018/012327
§ 371 (c)(1),
(2) Date: Sep. 26, 2019

(87) PCT Pub. No.: WO2018/186230
PCT Pub. Date: Oct. 11, 2018

(65) Prior Publication Data

US 2020/0140982 A1 May 7, 2020

(30) Foreign Application Priority Data

Apr. 4, 2017 (JP) ..... JP2017-074407
Oct. 19, 2017 (JP) ..... JP2017-202385

(51) Int. Cl.
*C22F 1/08* (2006.01)
*C22C 9/00* (2006.01)
*C22C 9/06* (2006.01)

(52) U.S. Cl.
CPC ..... *C22F 1/08* (2013.01); *C22C 9/00* (2013.01); *C22C 9/06* (2013.01)

(58) Field of Classification Search
CPC ..... C22F 1/08; C22C 9/00; C22C 9/06; C22C 9/10
See application file for complete search history.

(56) References Cited

U.S. PATENT DOCUMENTS

2011/0240180 A1* 10/2011 Gao ..... C22C 9/06 148/554
2012/0148439 A1* 6/2012 Shishido ..... C22C 9/06 420/473
2014/0193293 A1* 7/2014 Shishido ..... C22F 1/00 420/473
2016/0305001 A1* 10/2016 Kaneko ..... C22C 9/06

FOREIGN PATENT DOCUMENTS

| | | |
|---|---|---|
| JP | 2000-073130 | 3/2000 |
| JP | 2001-152303 | 6/2001 |
| JP | 2010-242177 | 10/2010 |
| JP | 2011-017072 | 1/2011 |
| JP | 2011-117034 | 6/2011 |
| JP | 2013-032564 | 2/2013 |
| JP | 2013-095976 | 5/2013 |
| JP | 2013-104078 | 5/2013 |
| JP | 2013095976 A * | 5/2013 |
| JP | 2013-173988 | 9/2013 |
| JP | 2014-156623 | 8/2014 |
| JP | 2016-047945 | 4/2016 |
| JP | 2017-179553 | 10/2017 |
| JP | 2018-035437 | 3/2018 |
| WO | 2013/069376 | 5/2013 |

* cited by examiner

*Primary Examiner* — John A Hevey
(74) *Attorney, Agent, or Firm* — Clark & Brody LP

(57) ABSTRACT

A copper alloy sheet material has a composition containing from 0.20 to 6.00% in total of Ni and Co, from 0 to 3.00% of Ni, from 0.20 to 4.00% of Co, and from 0.10 to 1.50% of Si, all in mass %, one or more of Fe, Mg, Zn, Mn, B, P, Cr, Al, Zr, Ti, Sn contained appropriately depending on necessity, the balance of Cu and unavoidable impurities, and has on a polished sheet surface thereof, a ratio $S_B/S_C$ of 2.0 or more and an area ratio of $S_B$ occupied on the surface of 5.0% or more, wherein $S_B$ represents an area of a region having a crystal orientation difference from a Brass orientation {011} <211> measured by EBSD (electron backscattered diffraction) of 100 or less, and $S_C$ represents an area of a region having a crystal orientation difference from a Cube orientation {001} <100> of 10° or less.

9 Claims, No Drawings

CU—CO—SI-BASED COPPER ALLOY SHEET MATERIAL AND METHOD FOR PRODUCING THE SAME, AND COMPONENT USING THE SHEET MATERIAL

TECHNICAL FIELD

The present invention relates to a Cu—Co—Si-based copper alloy sheet material adjusted to have high electroconductivity and a method for producing the same, and a current carrying component and a heat dissipation component using the Cu—Co—Si-based copper alloy sheet material.

BACKGROUND ART

A Cu—(Ni)—Co—Si-based copper alloy has a relatively good balance between strength and electroconductivity among copper alloys based on a so-called Corson alloy (Cu—Ni—Si based), and is useful as a current carrying component, such as a connector and a lead frame, and a heat dissipation component for an electronic device. In the following description, a copper alloy based on a Corson alloy will be referred to as a "Corson type copper alloy", and a Cu—(Ni)—Co—Si-based copper alloy including a case containing Ni will be referred to as a "Cu—Co—Si-based copper alloy". The Cu—Co—Si-based copper alloy can be adjusted to have a good strength-electroconductivity balance, for example, with a tensile strength of from 400 to 650 MPa and an electroconductivity of from 55 to 70% IACS.

A current carrying component and a heat dissipation component are frequently produced by subjecting a sheet material to press punching. From the standpoint of the dimensional accuracy of the component and the lifetime of the press mold, the copper alloy sheet material is demanded to have a good press punching capability capable of suppressing the burr height on the punched surface to a low level. In particular, components for consumer use are being decreased in size and pitch, and are increasingly demanded to have an enhanced press punching capability. There are cases where the production of a component is terminated before reaching the end of lifetime of the press mold therefor due to the continuous developments of new products, and there is a problem in the initial installation cost of the mold for press working. Furthermore, there are cases where a component having a smaller size and a complicated shape cannot be produced through press working. In view of the aforementioned problems, there are increasing needs for production of a component through etching. For addressing the needs, it is necessary to produce a component having a high shape accuracy through precision etching, and thus the material therefor is demanded to be capable of providing an etched surface with surface unevenness that is reduced as much as possible (i.e., with good surface smoothness).

Associated with the decrease in size and weight of electronic devices, there are increasing needs for the reduction in size and thickness of a current carrying component and a heat dissipation component. Accordingly, the excellent electroconductivity (thermal conductivity) is becoming important than the past. For the purposes, to which a Corson type copper alloy is applied, there are increasing cases requiring an electroconductivity, for example, of 55% IACS or more.

PTLs 1 and 2 each describe a Corson type copper alloy that is improved in press punching capability and press workability by controlling the texture thereof, and an example having Co added is also described (see No. 14, Table 1, PTL 1). However, the materials all have low electroconductivity.

PTL 3 describes a Corson type copper alloy that is improved in bending workability by controlling the texture to have 10% or more for each of the Cube orientation {001} <100> and the RDW orientation {210} <100>, and also describes a Cu—Co—Si-based copper alloy having characteristics with an electroconductivity of 55% IACS or more and a tensile strength of 660 MPa or more (Nos. 26 to 29 and 31, Table 1).

However, the materials do not intend to achieve the press punching capability with less burr and the excellent etching capability suitable for precision etching. In the production process thereof, the solution treatment is performed at an ordinary temperature of from 700 to 950° C. (see paragraph 0054). As will be described later, it is difficult to enhance significantly the press punching capability and the etching capability through a production process accompanied with a solution treatment.

PTL 4 describes a Cu—Co—Si-based copper alloy that is improved in bending workability after notching by controlling the maximum value of the X-ray random intensity ratio in a region including the {001} <100> orientation on the {200} pole figure, and an electroconductivity of 55% IACS or more can be obtained while retaining the high strength (see Table 1). However, the literature also does not intend to achieve the press punching capability with less burr and the excellent etching capability suitable for precision etching. In the working example thereof, a solution treatment is performed at 1,000° C. (see step 4, paragraph 0020), and thus no significant improvement in press punching capability and etching capability is achieved.

PTL 5 describes a Cu—Ni—Co—Si-based copper alloy with good press workability that is improved in strength by controlling the number density of precipitates. However, the electroconductivity thereof is low.

PTL 6 describes a copper alloy that is improved in strength and bending workability by controlling the length ratio of the low angle grain boundary and the like and the texture, and a Cu—Ni—Co—Si-based copper alloy is described in the working example. However, the electroconductivity thereof is low.

CITATION LIST

Patent Literatures

PTL 1: JP-A-2000-73130
PTL 2: JP-A-2001-152303
PTL 3: JP-A-2011-117034
PTL 4: JP-A-2013-32564
PTL 5: JP-A-2014-156623
PTL 6: JP-A-2016-47945

SUMMARY OF INVENTION

Technical Problem

A sheet material of a Corson type copper alloy focusing on high strength generally has a relatively good press punching capability but has a low electroconductivity. A Corson type copper alloy sheet material focusing on the strength-electroconductivity balance, in which the electroconductivity thereof is enhanced while appropriately retaining the strength level, is difficult to achieve the good press punching capability that the alloy focusing on high strength provides, and thus currently cannot sufficiently address the severe needs of decrease in size and pitch of components. Furthermore, the alloy focusing on the strength-electroconductivity balance cannot achieve the satisfactory level for the etching capability.

An object of the invention is to improve simultaneously the "press punching capability" and the "etching capability" of a sheet material of a Corson type copper alloy having enhanced electroconductivity, which has been difficult to achieve.

Solution to Problem

For achieving the object, the invention employs a Cu—Co—Si-based copper alloy, which is effective for providing a sheet material excellent in strength-electroconductivity balance. According to the investigations made by the present inventors, it has been found that a Cu—Co—Si-based copper alloy adjusted to have a texture with dominance of Brass orientation can be significantly improved in the press punching capability and the etching capability. It is considered that the lattice strain (dislocation) is accumulated in high density in the crystal grains in the process of forming the texture with dominance of Brass orientation, and the lattice strain contributes to the improvement of the press punching capability and the etching capability.

However, it is necessary to devise the Cu—Co—Si-based copper alloy with dominance of Brass orientation for achieving the good strength-electroconductivity balance. The Corson type copper alloy is originally such a copper alloy that achieves high strength through the utilization of aging precipitation. The electroconductivity is enhanced by the decrease of the dissolved element amount in the matrix (metal substrate) through the aging precipitation. However, a solution treatment is generally performed before the aging treatment, and the heat treatment therefor expunges the texture state with dominance of Brass orientation having the lattice strain (dislocation) accumulated in high density. It has been found that this can be solved by such a method that the solution treatment is omitted, and the combination of cold rolling and an aging treatment is performed plural times. In each of the plural aging treatments, the precipitation is accelerated with the strain introduced by the cold rolling as the driving force. According to the procedure, an aged structure can be obtained, in which the dissolved elements are sufficiently precipitated in the matrix to such an extent that is equivalent to or higher than the ordinary procedure where only one aging treatment is performed by the process combining (solution treatment (+cold rolling)+aging treatment), and thereby the good strength-electroconductivity balance can be obtained. In this case, the lattice strain can be left in high density, which is different from the ordinary material produced by the process including the solution treatment, and thereby the press punching capability and the etching capability can be enhanced.

The invention has been completed based on the aforementioned knowledge.

The following inventions are shown in the description herein.

[1] A copper alloy sheet material having a chemical composition containing from 0.20 to 6.00% in total of Ni and Co, from 0 to 3.00% of Ni, from 0.20 to 4.00% of Co, from 0.10 to 1.50% of Si, from 0 to 0.50% of Fe, from 0 to 0.20% of Mg, from 0 to 0.20% of Zn, from 0 to 0.10% of Mn, from 0 to 0.10% of B, from 0 to 0.10% of P, from 0 to 0.20% of Cr, from 0 to 0.20% of Al, from 0 to 0.20% of Zr, from 0 to 0.50% of Ti, from 0 to 0.20% of Sn, and the balance of Cu, all in terms of percentage by mass, with unavoidable impurities, and having, on a polished surface of a sheet surface (rolled surface) thereof, a ratio $S_B/S_C$ of 2.0 or more and an area ratio of $S_B$ occupied on the surface of 5.0% or more, wherein $S_B$ represents an area of a region having a crystal orientation difference from a Brass orientation {011} <211> measured by EBSD (electron backscattered diffraction) of 10° or less, and $S_C$ represents an area of a region having a crystal orientation difference from a Cube orientation {001} <100> of 10° or less.

[2] The copper alloy sheet material according to the item [1], wherein the copper alloy sheet material has a KAM value of more than 3.0° measured at a step size of 0.5 μm inside crystal grains, assuming that a boundary with a crystal orientation difference measured by EBSD of 15° or more is a crystal grain boundary.

[3] The copper alloy sheet material according to the item [1] or [2], wherein the copper alloy sheet material has an X-ray diffraction intensity ratio $X_{220}$ defined by the following expression (1) of 0.55 or more:

$$X_{220}=I\{220\}/(I\{111\}+I\{200\}+I\{220\}+I\{311\}+I\{331\}+I\{420\}) \quad (1)$$

wherein I{hkl} represents an integrated intensity of an X-ray diffraction peak of a {hkl} crystal face on the sheet surface (rolled surface) of the sheet material.

[4] The copper alloy sheet material according to any one of the items [1] to [3], wherein the copper alloy sheet material has an electroconductivity of from 55 to 80% IACS.

[5] The copper alloy sheet material according to any one of the items [1] to [4], wherein the copper alloy sheet material has a tensile strength in a direction in parallel to a rolling direction of from 500 to 750 MPa.

[6] The copper alloy sheet material according to any one of the items [1] to [5], wherein the copper alloy sheet material has a mass ratio (Ni+Co+Si residue)/(filtrate) defined by the following expression (2) of 2.0 or more determined by analysis of a residue and a filtrate obtained through extraction by dissolving a matrix (metal substrate) in a nitric acid aqueous solution having a concentration of 7 mol/L at 0° C.:

(mass ratio(Ni+Co+Si residue)/(filtrate))=(total mass of Ni, Co, and Si contained in residue (g))/(total mass of Ni, Co, and Si contained in filtrate (g)) (2)

[7] A method for producing a copper alloy sheet material, including in this order:

heating a cast piece of a copper alloy having the chemical composition according to the item [1] to from 980 to 1,060° C., and then subjecting to hot rolling with a rolling reduction ratio of from 80 to 97% (hot rolling step);

subjecting to cold rolling with a rolling reduction ratio of from 60 to 99% to provide a cold rolled material, and subjecting the cold rolled material to an aging treatment by retaining to from 300 to 650° C. for from 3 to 30 hours (first cold rolling and aging step);

subjecting an aged material obtained through the first cold rolling and aging step to cold rolling with a rolling reduction ratio of from 60 to 99% to provide a cold rolled material, and subjecting the cold rolled material to an aging treatment by retaining to from 350 to 500° C. for from 3 to 20 hours (second cold rolling and aging step);

subjecting to cold rolling with a rolling reduction ratio of from 10 to 50% (finish cold rolling step); and heating to from 300 to 500° C. for from 5 seconds to 1 hour (low temperature annealing step).

[8] The method for producing a copper alloy sheet material according to the item [7], wherein the method does not include a heat treatment accompanied by reduction in electroconductivity after the hot rolling step.

[9] A current carrying component containing the copper alloy sheet material according to any one of the items [1] to [6].

[10] A heat dissipation component containing the copper alloy sheet material according to any one of the items [1] to [6].

Among the aforementioned alloy elements, Ni, Fe, Mg, Zn, Mn, B, P, Cr, Al, Zr, Ti, and Sn are optionally added elements. In the item [8], the "heat treatment accompanied by reduction in electroconductivity" means a heat treatment that satisfies the expression A>B, wherein A represents the electroconductivity (% IACS) of the material immediately before the heat treatment, and B represents the electroconductivity (% IACS) of the material immediately after the heat treatment. Representative examples of the heat treatment include a so-called solution treatment and intermediate annealing accompanied by recrystallization. The values of $S_B$ and $S_C$ and the KAM (kernel average misorientation) value by EBSD (electron backscattered diffraction) and the X-ray diffraction intensity ratio $X_{220}$ may be obtained in the following manners.

[Method for Obtaining $S_B$ and $S_C$ by EBSD]

The sheet surface (rolled surface) is subjected to buff polishing and ion milling to prepare an observation surface (with a removal depth from the rolled surface of 1/10 of the sheet thickness), which is observed with an FE-SEM (field emission scanning electron microscope), and a measurement region of 300 μm×300 μm is measured for the crystal orientation by EBSD (electron backscattered diffraction) at a step size (measurement pitch) of 0.5 μm. The area of the region having a crystal orientation difference from the Brass orientation {011} <211> of 10° or less is designated as $S_B$, and the area of the region having a crystal orientation difference from the Cube orientation {001} <100> of 10° or less is designated as $S_C$ among the total measured area (300 μm×300 μm).

[Method for Obtaining KAM Value]

Assuming that the boundary with a crystal orientation difference determined from the aforementioned EBSD data of 15° or more is the crystal grain boundary, the KAM value inside the crystal grains is measured.

[Method for Obtaining X-Ray Diffraction Intensity Ratio $X_{220}$]

The sheet surface (rolled surface) is measured with an X-ray diffractometer under conditions of a Cu-Kα line, a tube voltage of 30 kV, and a tube current of 10 mA, so as to provide an X-ray diffraction pattern, from which I{111}, I{200}, I{220}, I{311}, I{331}, and I{420} are obtained, and the values are substituted into the following expression (1) to provide the X-ray diffraction intensity ratio $X_{220}$:

$$X_{220}=I\{220\}/(I\{111\}+I\{200\}+I\{220\}+I\{311\}+I\{331\}+I\{420\}) \quad (1)$$

wherein I{hkl} represents an integrated intensity of an X-ray diffraction peak of a {hkl} crystal face on the sheet surface (rolled surface) of the sheet material.

The KAM value determined by the measurement regions corresponds to the average value obtained in such a manner that for the electron beam irradiation spots disposed with a pitch of 0.5 μm, all the crystal orientation differences between the adjacent spots (which may be referred to as an "adjacent spot orientation difference") are measured, from which the measured values with an adjacent spot orientation difference of less than 15° are extracted and averaged. Accordingly, the KAM value is an index showing the lattice strain amount inside the crystal grains, and with a larger value thereof, the material can be evaluated as having large strain.

The rolling reduction ratio from a certain sheet thickness $t_0$ (mm) to another sheet thickness $t_1$ (mm) is obtained by the following expression (3):

$$\text{Rolling reduction ratio (\%)}=(t_0-t_1/t_0\times 100 \quad (3)$$

Advantageous Effects of Invention

According to the invention, the sheet material of a Cu—Co—Si-based copper alloy adjusted to have an electroconductivity of 55% IACS or more can have a small burr amount and excellent surface smoothness on the etched surface. Therefore, the invention contributes to the enhancement of the dimensional accuracy and the enhancement of the lifetime of the press mold in the production of a current carrying component and a heat dissipation component being decreased in size and pitch.

DESCRIPTION OF EMBODIMENTS

[Chemical Composition]

The invention employs a Cu—Co—Si-based copper alloy. In the following, the percentages for the alloy component are percentages by mass unless otherwise indicated.

In a Corson type copper alloy, Co forms a Co—Si-based precipitate. In the case where Ni is used as an added element, a Ni—Co—Si-based precipitate is formed. These precipitates improve the strength and the electroconductivity of the copper alloy sheet material. It is considered that the Co—Si-based precipitate is a compound mainly containing $CO_2Si$, and the Ni—Co—Si-based precipitate is a compound mainly containing $(Ni,Co)_2Si$. For the Corson type copper alloy containing Co, the heating temperature in hot rolling can be set to a higher value. It has been found that the dissolution of the aging precipitation element can be accelerated, and the solution treatment can be omitted, by setting the heating temperature in hot rolling to a higher value and sufficiently performing the reduction in a high temperature region. For sufficiently utilizing the function and achieving the good strength-electroconductivity balance, the Co content is necessarily 0.20% or more, and is more preferably 0.50% or more. However, a too large total amount of Ni and Co tends to form coarse precipitates and to decrease the electroconductivity. It is necessary that the Co content is 4.00% or less, and the total content of Co and Ni is 6.00% or less.

Ni forms a Ni—Co—Si-based precipitate together with Co to contribute to the enhancement of the strength, and thus may be added depending on necessity. In the case where Ni is added, it is more effective to add to provide a Ni content of 0.50% or more. However, an excessively large Ni content may form coarse precipitates, which may cause cracks in hot rolling. The Ni content is restricted to 3.00% or less, and it is necessary that the total content of Ni and Co is 6.00% or less, as described above.

Si is an element that forms a Co—Si-based precipitate or a Ni—Co—Si-based precipitate. For sufficiently dispersing fine precipitate particles effective for enhancing the strength, the Si content is necessarily 0.10% or more. On the other hand, an excessively large Si content may form coarse precipitates, which may cause cracks in hot rolling. The Si content is restricted to 1.50% or less and may be managed to less than 1.00%. The reduction as much as possible of the amounts of Ni, Co, and Si dissolved in the matrix (metal substrate) after the aging treatment is advantageous for the enhancement of the electroconductivity. Accordingly, it is effective therefor to control the mass ratio (Ni+Co)/Si to a range of from 3.50 to 5.00, and it is more preferred to control to a range of from 3.90 to 4.60.

As additional elements, Fe, Mg, Zn, Mn, B, P, Cr, Al, Zr, Ti, Sn, and the like may be contained. The ranges of the contents of these elements are preferably from 0 to 0.50% for Fe, from 0 to 0.20% for Mg, from 0 to 0.20% for Zn, from 0 to 0.10% for Mn, from 0 to 0.10% for B, from 0 to 0.10% for P, from 0 to 0.20% for Cr, from 0 to 0.20% for Al, from 0 to 0.20% for Zr, from 0 to 0.50% for Ti, and from 0 to 0.20% for Sn.

Cr, P, B, Mn, Ti, Zr, and Al have a function of further enhancing the alloy strength and decreasing the stress relaxation. Sn and Mg are effective for enhancing the stress relaxation resistance. Zn improves the solderability and the casting capability of the copper alloy sheet material. Fe, Cr, Zr, Ti, and Mn may form a high-melting point compound along with S, Pb, and the like existing as the unavoidable impurities, and B, P, Zr, and Ti have an effect of refining the cast structure and can contribute to the improvement of the hot rolling workability.

In the case where one kind or two or more kinds of Fe, Mg, Zn, Mn, B, P, Cr, Al, Zr, Ti, and Sn are contained, it is more effective that the total content thereof is 0.01% or more. However, a too large content thereof may adversely affect the hot or cold rolling workability, and may be disadvantageous in cost. The total amount of the optionally added elements is more desirably 1.0% or less.

[Crystal Orientation]

In the invention, the excellent press punching capability and etching capability are achieved with the crystal lattice strain in high density of the matrix (metal substrate) of the sheet material. According to the studies by the inventors, a sheet material of a Cu—Co—Si-based copper alloy that has a crystal orientation with certain dominance of Brass orientation has therein the lattice strain accumulated in the formation of the crystal orientation, and exhibits the excellent press punching capability and etching capability. The inventors have made various investigations on the index of the extent of the dominance of Brass orientation that is effective for the improvement of the press punching capability and the etching capability. As a result, it has been found that a significant improvement is observed on the press punching capability and the etching capability in the Cu—Co—Si-based copper alloy sheet material that has, on the polished surface of the sheet surface (rolled surface) thereof, a ratio $S_B/S_C$ of 2.0 or more and an area ratio of $S_B$ occupied on the surface of 5.0% or more, wherein $S_C$ represents the area of the region having a crystal orientation difference from a Brass orientation {011} <211> measured by EBSD (electron backscattered diffraction) of 10° or less, and $S_C$ represents the area of the region having a crystal orientation difference from a Cube orientation (001) <100> of 10° or less.

The crystal orientation with dominance of Brass orientation can also be confirmed by X-ray diffraction. Specifically, for example, it can be said that with a larger value of the X-ray diffraction intensity ratio $X_{220}$ defined by the following expression (1), the Brass orientation is more dominant.

$$X_{220}=I\{220\}/(I\{111\}+I\{200\}+I\{220\}+I\{311\}+I\{331\}+I\{420\}) \quad (1)$$

In the expression, I{hkl} represents an integrated intensity of an X-ray diffraction peak of a {hkl} crystal face on the sheet surface (rolled surface) of the sheet material.

According to the researches by the inventors, it has been found that a Cu—Co—Si-based copper alloy sheet material that has the aforementioned chemical composition and has a ratio $S_B/S_C$ of 2.0 or more and an area ratio of $S_B$ of 5.0% or more exhibits an X-ray diffraction intensity ratio $X_{220}$ of 0.55 or more. However, even a Cu—Co—Si-based copper alloy sheet material that has an X-ray diffraction intensity ratio $X_{220}$ of 0.55 or more cannot stably achieve the excellent press punching capability and etching capability unless the sheet material has a crystal orientation having a ratio $S_B/S_C$ of 2.0 or more and an area ratio of $S_B$ of 5.0% or more.

[KAM Value]

A KAM value measured by EBSD has been known as an index for evaluating the amount of crystal lattice strain (i.e., the extent of accumulation of dislocation) of a metal material. The inventors have found that the KAM value of a copper alloy sheet material largely influences the surface smoothness of the etched surface thereof. The mechanism therefor is not clarified currently, and is estimated as follows. The KAM value is a parameter that correlates to the dislocation density in crystal grains. In the case where the KAM value is large, it is considered that the average dislocation density in the crystal grains is high, and the positional fluctuation of the dislocation density is small. As for the etching, it is considered that a portion having a high dislocation density is preferentially etched (corroded). A material having a large KAM value is in a state where the overall material has a uniformly high dislocation density, and therefore, the corrosion by etching proceeds rapidly with less local corrosion occurring. It is estimated that this progress mode of corrosion advantageously acts on the formation of an etched surface with less unevenness. Consequently, a component that is good in shape accuracy and dimensional accuracy can be produced by etching process.

According to the researches by the inventors, it has been found that a Cu—Co—Si-based copper alloy sheet material that has the aforementioned chemical composition and has a ratio $S_B/S_C$ of 2.0 or more and an area ratio of $S_B$ of 5.0% or more has a KAM value of more than 3.0° measured at a step size of 0.5 μm inside crystal grains, assuming that a boundary with a crystal orientation difference measured by EBSD of 15° or more is a crystal grain boundary. The surface smoothness of the etched surface is significantly improved in the case where the KAM value is large in this way. However, even a Cu—Co—Si-based copper alloy sheet material that has a KAM value of more than 3.0° is insufficient in improvement of the press punching capability unless the sheet material has a crystal orientation having a ratio $S_B/S_C$ of 2.0 or more and an area ratio of $S_B$ of 5.0% or more. The upper limit of the KAM value is not particularly determined, and a KAM value of more than 3.0° and 5.0° or less can be achieved by controlling to provide the aforementioned crystal orientation.

[Strength-Electroconductivity Balance]

The invention aims a significant improvement of the press punching capability and the etching capability of a Corson type copper alloy sheet material having a strength-electroconductivity balance with a tensile strength in the direction in parallel to the rolling direction of from 500 to 750 MPa and an electroconductivity of 55% IACS or more. An electroconductivity of 55% IACS or more is a certainly high value for a Corson type copper alloy. A Corson type alloy that has an electroconductivity enhanced to this level has been difficult to achieve the enhancement of the press punching capability and the etching capability. A current carrying component and a heat dissipation component preferably have an electroconductivity (thermal conductivity) that is as high as possible, but the industrial achievement of an electroconductivity exceeding 80% IACS for a Cu—Co—Si-based copper alloy is too costly. A material having an electroconductivity of 80% IACS or less is targeted herein. As for the strength level, the production of a high-strength material of a Cu—Co—Si-based copper alloy that has a tensile strength exceeding 750 MPa is entirely possible. However, the electroconductivity is low in the high-strength material like this. Furthermore, a high-strength Corson type copper alloy having a tensile strength exceeding 750 MPa exhibits a small amount of burr occurring in press punching due to the high strength thereof. A Cu—Co—Si-based copper alloy having a strength level with a tensile strength of 750 MPa or less, which has been demanded to have further improved press punching capability, is targeted herein.

[Mass Ratio (Ni+Co+Si Residue)/(Filtrate)]

The mass ratio (Ni+Co+Si residue)/(filtrate) defined by the following expression (2) is an index for evaluating the extent of Ni, Co, and Si contained in the alloy that are actually precipitated as precipitates and the extent thereof that are dissolved in the matrix. A nitric acid aqueous solution having a concentration of 7 mol/L at 0° C. can dissolve the matrix (metal substrate) of the copper alloy having the aforementioned compositional range and can extract the precipitates as a residue.

(mass ratio(Ni+Co+Si residue)/(filtrate))=(total mass of Ni, Co, and Si contained in residue (g))/(total mass of Ni, Co, and Si contained in filtrate (g)) (2)

The mass ratio (Ni+Co+Si residue)/(filtrate) largely influences the strength-electroconductivity balance. In the case where the mass ratio (Ni+Co+Si residue)/(filtrate) is small despite a certain amount of Ni, Co, and Si contained, a structure state with low electroconductivity is provided due to the large amount of Ni, Co, and Si dissolved. According to the investigations by the inventors, a Cu—Co—Si-based copper alloy having the aforementioned chemical composition that has a mass ratio (Ni+Co+Si residue)/(filtrate) of 2.0 or more can provide a strength-electroconductivity level with a tensile strength of 500 MPa or more and an electroconductivity of 55% IACS or more.

By using the copper alloy sheet material according to the invention as described above, the enhancement of the dimensional accuracy and the enhancement of the lifetime of the press mold can be achieved in the production of a current carrying component and a heat dissipation component being decreased in size and pitch. The current carrying component is suitably applied to such a purpose that requires fine and accurate processing, such as a lead frame, a connector, and a component of a voice coil motor (VCM, an electronic component that performs focusing of a camera installed in a smartphone).

[Production Method]

The copper alloy sheet material described above can be produced, for example, by the following production process.

Melting and casting→hot rolling→first cold rolling→first aging treatment→second cold rolling→second aging treatment→finish cold rolling→low temperature annealing While not shown in the aforementioned process, facing may be performed after the hot rolling depending on necessity, and pickling, grinding, and further degreasing may be performed after each of the heating treatments depending on necessity. The process steps will be described below.

[Melting and Casting]

A cast piece may be produced by an ordinary method by continuous casting, semi-continuous casting, or the like. The process step is preferably performed in an inert gas atmosphere or with a vacuum melting furnace for preventing oxidation of Si and the like.

[Hot Rolling]

The hot rolling is preferably performed in a temperature range that is shifted to a higher temperature than the ordinary temperature applied to a Corson type copper alloy. The heating of the cast piece before the hot rolling may be performed, for example, at from 980 to 1,060° C. for from 1 to 5 hours, and the total hot rolling reduction ratio may be, for example, from 85 to 97%. The rolling temperature of the final pass is preferably 700° C. or more, and thereafter, the quenching is preferably performed by water cooling or the like. The alloy targeted in the invention containing the prescribed amount of Co requires the heating to a high temperature and the hot working at a high temperature, and thereby the homogenization of the cast structure and the dissolution of the alloy elements can be accelerated. The homogenization of the structure and the dissolution in the hot rolling step are significantly effective for sufficiently causing aging precipitation in the process having no solution treatment performed. The sheet thickness after the hot rolling may be set, for example, to a range of from 10 to 20 mm depending on the final target sheet thickness.

[First Cold Rolling and Aging Treatment]

For achieving the aforementioned crystal orientation and strength-electroconductivity balance, it is significantly effective to perform twice or more the process including "cold rolling and then aging treatment". The first process is referred to as a "first cold rolling and aging treatment". In the process combining cold rolling and an aging treatment, the dislocations having been introduced in a large amount through the cold rolling function as nucleus formation sites in the aging treatment, so as to accelerate the precipitation. The rolling reduction ratio in the first cold rolling is preferably 60% or more. In consideration of the specification of the cold rolling machine, the rolling reduction ratio in the first cold rolling may be set to a range of 99% or less. The first aging treatment performed subsequent to the first cold rolling is preferably performed under the condition where the material is retained at from 300 to 650° C. for from 3 to 30 hours. There have been cases where so-called intermediate annealing is performed between cold rolling steps in the production process of a Corson type copper alloy, but the first aging treatment herein is different from the ordinary intermediate annealing, but mainly aims to cause aging precipitation sufficiently. Accordingly, the treatment requires heating for 3 hours or more in the aforementioned temperature range. In the case where the heating temperature exceeds 650° C., the strain imparted in the cold rolling may be excessively removed to prevent the sufficient progression of the formation of precipitates, and furthermore the crystal orientation with dominance of Brass orientation cannot be achieved due to the occurrence of recrystallization.

[Second Cold Rolling and Aging Treatment]

The first aging treatment is applied to the state where the solution treatment is omitted, and therefore is disadvantageous for performing the precipitation completely, as compared to the ordinary aging treatment performed after the solution treatment. Accordingly, the second cold rolling is performed for the material having precipitates formed in the first aging treatment, so as to introduce dislocations thereto again. In the second cold rolling employed as the final combination of "cold rolling and then aging treatment", cold rolling with a rolling reduction ratio of from 60 to 99% is performed. The second aging treatment performed subsequent to the second cold rolling is preferably performed under conditions where the material is retained at from 350 to 500° C. for from 3 to 30 hours. In the first aging treatment described above, a temperature up to 650° C. is allowable. In the second aging treatment, however, the temperature is preferably 500° C. or less for preventing the significant reduction of the strength and the deterioration of the bending workability due to the excessive growth of the precipitates formed in the first aging treatment.

The process combining "cold rolling and then aging treatment" may be performed once or twice or more after the second aging treatment, corresponding to the target sheet thickness. In this case, the conditions of the cold rolling and aging treatment performed intermediately may be set to the condition ranges for the first cold rolling and the first aging treatment, and the conditions of the cold rolling and aging treatment performed finally may be set to the condition ranges for the second cold rolling and the second aging treatment.

[Finish Cold Rolling]

The final cold rolling performed after the final aging treatment is referred to as "finish cold rolling" in the description herein. The finish cold rolling is effective for the enhancement of the strength and the KAM value. The finish cold rolling reduction ratio is effectively 10% or more. In the case where the finish cold rolling reduction ratio is excessively large, the strength may be decreased in the low temperature annealing, and thus the rolling reduction ratio is preferably 50% or less, and may be managed to a range of 35% or less. The final sheet thickness may be set, for example, to a range of approximately from 0.06 to 0.40 mm.

[Low Temperature Annealing]

After the finish cold rolling, low temperature annealing is generally performed for the purpose of the decrease of the residual stress and the enhancement of the bending workability of the sheet material, and the enhancement of the stress relaxation resistance through the decrease of the voids and the dislocations on the slip plane. The low temperature annealing may be set to a condition range of heating to from 300 to 500° C. for from S seconds to 1 hour.

As described above, a Cu—Co—Si-based copper alloy sheet material with dominance of Brass orientation having good electroconductivity can be obtained by the method of performing the process including "cold rolling and then aging treatment" plural times without a dissolution treatment performed.

EXAMPLES

Copper alloys having the chemical compositions shown in Table 1 were manufactured, and cast with a vertical semi-continuous casting machine. The resulting cast piece was heated to 1,000° C. for 3 hours, then extracted, and subjected to hot rolling to a thickness of 10 mm, followed by cooling with water. The total hot rolling reduction ratio was from 90 to 95%. After the hot rolling, the oxidized layer as the surface layer was removed by mechanical grinding (facing), and sheet material products (test materials) having a sheet thickness of 0.15 mm were obtained through the following production process A or B. Corresponding to the cold rolling reduction ratio in the cold rolling step, the thickness was controlled in advance by the facing to regulate the final sheet thickness to 0.15 mm. The production process B includes a solution treatment introduced between the second cold rolling and the second aging treatment of the production process A. In this case, the heat treatment after the first cold rolling becomes "intermediate annealing", and the aging treatment is only once after the solution treatment.

(Production Process)

A: first cold rolling→first aging treatment→second cold rolling→second aging treatment→finish cold rolling→low temperature annealing B: first cold rolling→intermediate annealing→second cold rolling→solution treatment→aging treatment→finish cold rolling→low temperature annealing The major production conditions are shown in Table 2. The periods of time of the first aging treatment in the production process A and the intermediate annealing in the production process B each are 6 hours. The periods of time of the second aging treatment in the production process A and the aging treatment in the production process B each are 6 hours. The low temperature annealing was performed under conditions of 400° C. for 1 minute.

Before and after the first aging treatment and the second aging treatment in the production process A, and before and after the intermediate annealing, the solution treatment, and the aging treatment in the production process B, the intermediate products were measured for the electroconductivity by the method described later. The results are shown in Table 2. In all the examples, the electroconductivity was increased in the first aging treatment or the intermediate annealing, and the second aging treatment or the aging treatment, from which it was understood that recrystallization did not occur in these heat treatments.

TABLE 1

| | | Chemical composition (% by mass)f | | | | | | |
|---|---|---|---|---|---|---|---|---|
| Class | No. | Cu | Ni | Co | Si | Others | Ni + Co | (Ni + Co)/Si |
| Example of Invention | 1 | balance | 2.48 | 1.33 | 0.87 | Mg:0.04 | 3.81 | 4.38 |
| | 2 | balance | 2.64 | 1.25 | 0.92 | — | 3.89 | 4.23 |
| | 3 | balance | 0.52 | 0.53 | 0.26 | — | 1.05 | 4.04 |
| | 4 | balance | 2.81 | 1.13 | 0.95 | Al:0.15,Cr:0.08 | 3.94 | 4.15 |
| | 5 | balance | 1.35 | 1.80 | 0.71 | Mn:0.08 | 3.15 | 4.44 |
| | 6 | balance | 0.73 | 0.79 | 0.36 | Ti:0.05 | 1.52 | 4.22 |
| | 7 | balance | 2.43 | 1.52 | 0.91 | Zr:0.13,P:0.05 | 3.95 | 4.34 |
| | 8 | balance | 2.35 | 1.35 | 0.95 | B:0.004,Cr:0.08 | 3.70 | 3.89 |
| | 9 | balance | 0.60 | 2.80 | 0.81 | Fe:0.08,Zn:0.14 | 3.40 | 4.20 |
| | 10 | balance | 1.42 | 1.31 | 0.65 | Fe:0.13,P:0.05 | 2.73 | 4.20 |
| | 11 | balance | 1.43 | 1.30 | 0.59 | — | 2.73 | 4.63 |
| | 12 | balance | 0.00 | 0.82 | 0.19 | — | 0.82 | 4.32 |
| | 13 | balance | 0.00 | 3.06 | 0.71 | — | 3.06 | 4.31 |
| | 14 | balance | 2.65 | 1.22 | 0.87 | Sn:0.08 | 3.87 | 4.45 |
| | 15 | balance | 2.64 | 1.25 | 0.85 | — | 3.89 | 4.58 |

TABLE 1-continued

| Class | No. | Chemical composition (% by mass)f | | | | | | |
|---|---|---|---|---|---|---|---|---|
| | | Cu | Ni | Co | Si | Others | Ni + Co | (Ni + Co)/Si |
| | 16 | balance | 1.69 | 1.54 | 0.75 | — | 3.23 | 4.31 |
| | 17 | balance | 0.00 | 3.60 | 0.86 | — | 3.60 | 4.19 |
| | 18 | balance | 1.50 | 1.10 | 0.60 | — | 2.60 | 4.33 |
| Comparative | 31 | balance | 2.48 | 1.33 | 0.87 | M:0.04 | 3.81 | 4.38 |
| Example | 32 | balance | 2.64 | 1.25 | 0.92 | — | 3.89 | 4.23 |
| | 33 | balance | 0.16 | 1.09 | 0.29 | — | 1.25 | 4.31 |
| | 34 | balance | 2.41 | 0.52 | 0.82 | Zr:0.09 | 2.93 | 3.57 |
| | 35 | balance | 0.00 | 3.32 | 0.79 | — | 3.32 | 4.20 |
| | 36 | balance | 0.80 | 2.60 | 0.81 | — | 3.40 | 4.20 |
| | 37 | balance | 0.45 | 0.51 | 0.22 | — | 0.96 | 4.36 |
| | 38 | balance | 2.70 | 0.52 | 0.76 | Ti:0.10 | 3.22 | 4.24 |
| | 39 | balance | 3.52* | 3.41 | 1.74 | — | 6.93* | 3.98 |
| | 40 | balance | 0.14 | 0.15* | 0.07* | — | 0.29 | 4.14 |
| | 41 | balance | 2.48 | 0.00* | 0.60 | — | 2.48 | 4.13 |
| | 42 | balance | 2.37 | 1.34 | 0.95 | Sn:0.70* | 3.71 | 3.91 |
| | 43 | balance | 2.28 | 1.34 | 0.95 | Cr:0.34* | 3.62 | 3.81 |

Cells with asterisk *: outside scope of invention

TABLE 2

| Class | No. | Production process | First cold rolling Rolling reduction ratio (%) | A: First aging treatment B: Intermediate annealing Electro-conductivity (before) (% IACS) | Treatment temperature (° C.) | Electro-conductivity (after) (% IACS) | Second cold rolling Rolling reduction ratio (%) |
|---|---|---|---|---|---|---|---|
| Example of Invention | 1 | A | 85 | 26 | 600 | 58 | 85 |
| | 2 | A | 90 | 27 | 650 | 61 | 80 |
| | 3 | A | 85 | 31 | 450 | 60 | 88 |
| | 4 | A | 85 | 26 | 550 | 50 | 85 |
| | 5 | A | 85 | 28 | 500 | 53 | 85 |
| | 6 | A | 90 | 28 | 500 | 56 | 83 |
| | 7 | A | 95 | 28 | 400 | 52 | 60 |
| | 8 | A | 90 | 27 | 490 | 54 | 83 |
| | 9 | A | 90 | 28 | 530 | 58 | 83 |
| | 10 | A | 80 | 27 | 570 | 52 | 90 |
| | 11 | A | 90 | 29 | 550 | 51 | 80 |
| | 12 | A | 85 | 31 | 510 | 67 | 85 |
| | 13 | A | 60 | 29 | 400 | 52 | 95 |
| | 14 | A | 70 | 27 | 380 | 47 | 94 |
| | 15 | A | 90 | 27 | 500 | 52 | 83 |
| | 16 | A | 90 | 28 | 450 | 55 | 83 |
| | 17 | A | 90 | 29 | 400 | 54 | 83 |
| | 18 | A | 85 | 29 | 450 | 60 | 85 |
| Comparative Example | 31 | B | 90 | 28 | 500 | 53 | 83 |
| | 32 | B | 90 | 28 | 550 | 54 | 83 |
| | 33 | B* | 90 | 29 | 500 | 59 | 83 |
| | 34 | B* | 85 | 29 | 600 | 55 | 85 |
| | 35 | B* | 90 | 28 | 500 | 63 | 80 |
| | 36 | B* | 90 | 28 | 550 | 55 | 80 |
| | 37 | B* | 90 | 31 | 550 | 51 | 80 |
| | 38 | B* | 90 | 29 | 600 | 50 | 80 |
| | 39 | A | 90 | 26 | 550 | 35 | 83 |
| | 40 | A | 90 | 35 | 420 | 66 | 83 |
| | 41 | A | 90 | 30 | 500 | 47 | 83 |
| | 42 | A | 90 | 29 | 450 | 42 | 83 |
| | 43 | A | 90 | 28 | 500 | 57 | 83 |

| | Solution treatment Electro-conductivity (before) (% IACS) | Treatment temperature (° C.) | Electro-conductivity (after) (% IACS) | A: Second aging treatment B: Aging treatment Electro-conductivity (before) (% IACS) | Treatment temperature (° C.) | Electro-conductivity (after) (% IACS) | Finish cold rolling Rolling reduction ratio (%) |
|---|---|---|---|---|---|---|---|
| Example of Invention | — | — | — | 55 | 500 | 63 | 33 |
| | — | — | — | 57 | 380 | 65 | 25 |
| | — | — | — | 53 | 430 | 71 | 17 |
| | — | — | — | 48 | 470 | 56 | 33 |
| | — | — | — | 49 | 440 | 57 | 33 |

TABLE 2-continued

| | | | | | | | |
|---|---|---|---|---|---|---|---|
| | | — | — | 52 | 430 | 60 | 12 |
| | — | — | — | 49 | 400 | 59 | 25 |
| | — | — | — | 50 | 370 | 57 | 12 |
| | — | — | — | 52 | 470 | 63 | 12 |
| | — | — | — | 49 | 450 | 58 | 25 |
| | — | — | — | 47 | 480 | 56 | 25 |
| | — | — | — | 60 | 440 | 75 | 33 |
| | — | — | — | 49 | 410 | 57 | 25 |
| | — | — | — | 44 | 500 | 56 | 17 |
| | — | — | — | 50 | 420 | 57 | 12 |
| | — | — | — | 53 | 450 | 60 | 12 |
| | — | — | — | 52 | 480 | 63 | 12 |
| | — | — | — | 55 | 400 | 63 | 26 |
| Comparative | 51* | 1000* | 17* | 17 | 470 | 42 | 12 |
| Example | 51* | 900* | 19* | 18 | 460 | 51 | 12 |
| | 55* | 1000* | 17* | 16 | 550* | 65 | 12 |
| | 52* | 750* | 24* | 23 | 480 | 50 | 33 |
| | 59* | 800* | 22* | 22 | 600* | 53 | 25 |
| | 52* | 700* | 27* | 26 | 480 | 64 | 25 |
| | 48* | 750* | 25* | 25 | 400 | 68 | 25 |
| | 47* | 750* | 25* | 25 | 450 | 43 | 25 |
| | — | — | — | 33 | 480 | 41 | 12 |
| | — | — | — | 62 | 440 | 78 | 12 |
| | — | — | — | 43 | 440 | 53 | 12 |
| | — | — | — | 40 | 525* | 48 | 12 |
| | — | — | — | 52 | 500 | 62 | 12 |

Cells with asterisk *: Outside scope of invention

The sheet material products (test materials) finally obtained were investigated as follows.

(Ratio $S_B/S_C$ and $S_B$ Area Ratio)

The area $S_B$ of the region having a crystal orientation difference from a Brass orientation {011} <211> of 10° or less and the area $S_C$ of the region having a crystal orientation difference from a Cube orientation {001} <100> of 10° or less were obtained according to the "Method for obtaining $S_B$ and $S_C$ by EBSD" described above with FE-SEM equipped with an EBSD analysis system (JSM-7001, produced by JEOL, Ltd.), and the ratio $S_B/S_C$ and the $S_B$ area ratio were calculated. The acceleration voltage of the electron beam irradiation was 15 kV, and the irradiation current thereof was $5\times10^{-8}$ A. The EBSD analysis software used was OIM Analysis, produced by TSL Solutions, Ltd. The area ratio of $S_B$ is a proportion (%) of $S_B$ occupied in the total area of the measured region.

(KAM Value)

The KAM value was obtained by analyzing the aforementioned EBSD measurement data according to the "Method for obtaining KAM Value" described above.

(X-ray Diffraction Intensity Ratio $X_{220}$)

X220 was obtained according to the "Method for obtaining X-ray Diffraction Intensity Ratio $X_{220}$" described above with an X-ray diffractometer (D2 Phaser, produced by Bruker AXS GmbH).

(Mass Ratio (Ni+Co+Si Residue)/(Filtrate))

A specimen was collected from the test material (thickness: 0.15 mm), and after removing the surface oxidized layer, the specimen was divided into small pieces of 1 mm×1 mm. Approximately 1 g of the small pieces were immersed in 100 mL of a nitric acid aqueous solution having a concentration of 7 mol/L at 0° C. for 20 minutes in a glass beaker, so as to dissolve the matrix (metal substrate). The insoluble residue (precipitate) remaining in the solution was separated by suction filtration with a Nuclepore filter having a pore diameter of 50 nm. The residue and the filtrate thus recovered each were analyzed for Ni, Co, and Si by ICP emission spectroscopy, and the mass ratio (Ni+Co+Si residue)/(filtrate) was obtained according to the following expression (2). The residue was dissolved by using hydrofluoric acid.

(mass ratio(Ni+Co+Si residue)/(filtrate))=(total mass of Ni, Co, and Si contained in residue (g))/(total mass of Ni, Co, and Si contained in filtrate (g)) (2)

(Press Punching Capability)

The test material having a sheet thickness of 0.15 mm was used as a processed material and subjected to a press punching test by punching a hole having a diameter of 10 mm with one press punching die. The press punching was performed 50,000 times under condition of a clearance of 10%, and the 50,000th punched material was investigated for the status of occurrence of burr on the punched surface. The burr height was measured according to JCBA T310: 2002, and in the case where the height was 5 μm or less, it was evaluated that the lifetime of the die was longer than the ordinary Cu—Co—Si-based copper alloy sheet material adjusted to have an electroconductivity of 55% or more, and the press punching capability was significantly improved. Accordingly, the case where the burr height of the 50,000th specimen was 5 μm or less was evaluated as A (press punching capability: excellent), the other was evaluated as B (press punching capability: poor), and the evaluation A was judged as acceptable.

(Etching Capability)

The etching solution used was a ferric chloride solution of 42 Baume. The surface of one side of the test material was etched until the sheet thickness was reduced half. The resulting etched surface was measured for the surface roughness in the direction perpendicular to the rolling direction with a laser surface roughness meter, and the arithmetic average roughness Ra was obtained according to JIS B0601: 2013. In the case where the value of Ra in the etching test was 0.15 μm or less, it was evaluated that the surface smoothness of the etched surface was significantly improved, as compared to the ordinary Corson type copper alloy sheet material. In other words, the specimen had such an etching capability that a component excellent in shape accuracy and dimensional accuracy can be produced by etching. Accordingly, the case where the value of Ra was 0.15 μm or less was evaluated as A (etching capability:

excellent), the other was evaluated as B (etching capability: poor), and the evaluation A was judged as acceptable.

(Tensile Strength and Blectroconductivity)

A tensile test piece (JIS No. 5) in the rolling direction (LD) was collected from the test material, and measured for the tensile strength by performing a tensile test according to JIS Z2241 with a number of test pieces n of 3. The average value of the three test pieces (n=3) was designated as the result value of the test material. The test material was measured for the electroconductivity according to JIS H0505. In consideration of the applicability to various current carrying components and heat dissipation components, a specimen having a tensile strength of 500 MPa or more and an electroconductivity of 55% IACS or more was evaluated as A (strength-electroconductivity balance: excellent), the other was evaluated as B (strength-electroconductivity balance: poor), and the evaluation A was judged as acceptable.

The results are shown in Table 3.

On the other hand, the comparative examples Nos. 31 to 38 were controlled variously in the strength-electroconductivity balance by the solution treatment and the aging treatment. These materials each were low in the ratio $S_B/S_C$ and the $S_B$ area ratio and failed to provide a crystal orientation with dominance of Brass orientation evaluated by EBSD, due to the solution treatment performed. Among these, Nos. 31 and 32 each were good in the press punching capability since these are high-strength materials having a tensile strength exceeding 750 MPa, but the remaining Nos. 33 to 38 were inferior in the press punching capability. However, Nos. 31 and 32 had low electroconductivity and were not improved in the etching capability. No. 34 seemed to have dominance of Brass orientation from the X-ray diffraction intensity ratio $X_{220}$, but had a crystal orientation low in the ratio $S_B/S_C$ and the $S_B$ area ratio, and inferior in the press punching capability and the etching capability. No. 36 provided a structure state with a high KAM value since the solution treatment was performed at a relatively low temperature of 700° C., providing good etching capability,

TABLE 3

| | | EBSD | | | | ICP analysis Mass ratio | Evaluation | Evaluation | Strength-electroconductivity balance | | |
|---|---|---|---|---|---|---|---|---|---|---|---|
| Class | No. | SB/SC | SB area ratio (%) | KAM value (°) | X-ray diffraction $X_{220}$ | (Ni + Co + Si residue)/(filtrate) | of press punching capability | of etching capability | Tensile strength (MPa) | Electro-conductivity (% IACS) | Evaluation |
| Example of Invention | 1 | 2.3 | 8.5 | 3.2 | 0.66 | 8.2 | A | A | 634 | 62 | A |
| | 2 | 2.7 | 5.4 | 3.1 | 0.60 | 6.3 | A | A | 687 | 57 | A |
| | 3 | 4.0 | 10.2 | 3.8 | 0.64 | 3.2 | A | A | 514 | 69 | A |
| | 4 | 2.9 | 9.3 | 3.4 | 0.63 | 2.1 | A | A | 732 | 55 | A |
| | 5 | 3.3 | 12.6 | 3.6 | 0.61 | 2.7 | A | A | 603 | 56 | A |
| | 6 | 2.8 | 8.9 | 3.1 | 0.58 | 2.6 | A | A | 707 | 59 | A |
| | 7 | 4.6 | 14.1 | 3.9 | 0.75 | 8.9 | A | A | 658 | 62 | A |
| | 8 | 5.1 | 11.8 | 3.6 | 0.64 | 3.5 | A | A | 703 | 57 | A |
| | 9 | 2.2 | 8.2 | 3.3 | 0.61 | 5.8 | A | A | 661 | 61 | A |
| | 10 | 2.7 | 7.4 | 3.4 | 0.64 | 4.4 | A | A | 603 | 58 | A |
| | 11 | 9.8 | 18.6 | 4.2 | 0.68 | 3.8 | A | A | 621 | 56 | A |
| | 12 | 4.9 | 12.0 | 4.2 | 0.63 | 4.9 | A | A | 523 | 73 | A |
| | 13 | 7.7 | 15.9 | 4.3 | 0.67 | 2.9 | A | A | 642 | 56 | A |
| | 14 | 5.6 | 16.7 | 3.9 | 0.69 | 5.4 | A | A | 693 | 56 | A |
| | 15 | 5.8 | 13.4 | 4.0 | 0.76 | 6.3 | A | A | 628 | 58 | A |
| | 16 | 7.7 | 10.7 | 4.3 | 0.67 | 6.6 | A | A | 602 | 62 | A |
| | 17 | 3.3 | 6.4 | 3.2 | 0.59 | 7.1 | A | A | 545 | 67 | A |
| | 18 | 6.8 | 9.0 | 3.9 | 0.58 | 4.2 | A | A | 660 | 63 | A |
| Comparative Example | 31 | 0.3* | 2.4* | 2.4 | 0.32 | 0.4 | A | B | 814 | 42 | B |
| | 32 | 0.5* | 2.7* | 2.5 | 0.36 | 1.3 | A | 6 | 763 | 51 | B |
| | 33 | 0.6* | 4.6* | 2.1 | 0.26 | 1.8 | B | B | 721 | 63 | A |
| | 34 | 1.3* | 3.3* | 2.8 | 0.57 | 0.7 | B | B | 662 | 49 | B |
| | 35 | 1.0* | 2.6* | 2.2 | 0.40 | 1.5 | B | B | 642 | 53 | B |
| | 36 | 0.9* | 4.6* | 3.2 | 0.56 | 3.2 | B | A | 653 | 62 | A |
| | 37 | 1.2* | 3.5* | 2.4 | 0.38 | 1.3 | B | B | 607 | 63 | A |
| | 38 | 1.6* | 4.2* | 2.6 | 0.30 | 1.0 | B | B | 717 | 43 | B |
| | 39 | 3.8 | 14.6 | 3.4 | 0.59 | 0.8 | A | A | 734 | 41 | B |
| | 40 | 5.7 | 16.1 | 3.9 | 0.67 | 6.7 | A | A | 468 | 76 | B |
| | 41 | 4.2 | 11.4 | 3.5 | 0.63 | 0.8 | A | A | 688 | 52 | B |
| | 42 | 2.3 | 10.8 | 3.5 | 0.70 | 1.4 | A | A | 695 | 48 | B |
| | 43 | 3.3 | 10.3 | 3.2 | 0.58 | 4.2 | B | A | 682 | 61 | A |

Cells with asterisk *: Outside scope of invention

The examples of the invention strictly controlled in the chemical composition and the production conditions each were a sheet material with dominance of Brass orientation exhibiting a high KAM value, and were excellent in the press punching capability and the etching capability, and good in the strength-electroconductivity balance.

but was not improved in the press punching capability due to the crystal orientation low in the ratio $S_B/S_C$ and the $S_B$ area ratio. Nos. 39 to 43 were outside the chemical composition defined in the invention. These materials employed the production process A having no solution treatment performed, but failed to have evaluation A (good evaluation)

simultaneously in all the press punching capability, the etching capability, and the strength-electroconductivity balance.

The invention claimed is:

1. A copper alloy sheet material having a chemical composition containing from 0.20 to 6.00% in total of Ni and Co, from 0 to 3.00% of Ni, from 0.20 to 4.00% of Co, from 0.10 to 1.50% of Si, from 0 to 0.50% of Fe, from 0 to 0.20% of Mg, from 0 to 0.20% of Zn, from 0 to 0.10% of Mn, from 0 to 0.10% of B, from 0 to 0.10% of P, from 0 to 0.20% of Cr, from 0 to 0.20% of Al, from 0 to 0.20% of Zr, from 0 to 0.50% of Ti, from 0 to 0.20% of Sn, and the balance of Cu, all in terms of percentage by mass, with unavoidable impurities, and having, on a polished surface of a sheet surface thereof, a ratio $S_B/S_C$ of 2.0 or more and an area ratio of $S_B$ occupied on the surface of 5.0% or more, wherein $S_B$ represents an area of a region having a crystal orientation difference from a Brass orientation {011} <211> measured by EBSD (electron backscattered diffraction) of 10° or less, and $S_C$ represents an area of a region having a crystal orientation difference from a Cube orientation {001} <100> of 10° or less, wherein the copper alloy sheet material has an electroconductivity of from 55 to 80% IACS.

2. The copper alloy sheet material according to claim 1, wherein the copper alloy sheet material has a KAM value of more than 3.0° measured at a step size of 0.5 μm inside crystal grains, assuming that a boundary with a crystal orientation difference measured by EBSD of 15° or more is a crystal grain boundary.

3. The copper alloy sheet material according to claim 1, wherein the copper alloy sheet material has an X-ray diffraction intensity ratio $X_{220}$ defined by the following expression (1) of 0.55 or more:

$$X_{220}=I\{220\}/(I\{111\}+I\{200\}+I\{220\}+I\{311\}+I\{331\}+I\{420\}) \quad (1)$$

wherein I{hkl} represents an integrated intensity of an X-ray diffraction peak of a {hkl} crystal face on the sheet surface (rolled surface) of the sheet material.

4. The copper alloy sheet material according to claim 1, wherein the copper alloy sheet material has a tensile strength in a direction in parallel to a rolling direction of from 500 to 750 MPa.

5. The copper alloy sheet material according to claim 1, wherein the copper alloy sheet material has a mass ratio (Ni+Co+Si residue)/(filtrate) defined by the following expression (2) of 2.0 or more determined by analysis of a residue and a filtrate obtained through extraction by dissolving a matrix in a nitric acid aqueous solution having a concentration of 7 mol/L at 0° C.:

(mass ratio(Ni+Co+Si residue)/(filtrate))=(total mass of Ni, Co, and Si contained in precipitates in a sample of the copper steel sheet material subjected to a dissolution test (g))/(total mass of Ni, Co, and Si dissolved in a matrix of the sample of the copper sheet material subjected to the dissolution test (g)) (2).

6. A method for producing a copper alloy sheet material according to claim 1, comprising, in this order:

heating a cast piece of a copper alloy having a chemical composition containing from 0.20 to 6.00% in total of Ni and Co, from 0 to 3.00% of Ni, from 0.20 to 4.00% of Co, from 0.10 to 1.50% of Si, from 0 to 0.50% of Fe, from 0 to 0.20% of Mg, from 0 to 0.20% of Zn, from 0 to 0.10% of Mn, from 0 to 0.10% of B, from 0 to 0.10% of P, from 0 to 0.20% of Cr, from 0 to 0.20% of Al, from 0 to 0.20% of Zr, from 0 to 0.50% of Ti, from 0 to 0.20% of Sn, and the balance of Cu, all in terms of percentage by mass, with unavoidable impurities, to from 980 to 1,060° C., and then subjecting to hot rolling with a rolling reduction ratio of from 80 to 97%;

subjecting to cold rolling with a rolling reduction ratio of from 60 to 99% to provide a cold rolled material, and subjecting the cold rolled material to an aging treatment by retaining to from 300 to 650° C. for from 3 to 30 hours;

subjecting an aged material obtained through the first cold rolling and aging step to cold rolling with a rolling reduction ratio of from 60 to 99% to provide a cold rolled material, and subjecting the cold rolled material to an aging treatment by retaining to from 350 to 500° C. for from 3 to 20 hours;

subjecting to cold rolling with a rolling reduction ratio of from 10 to 50%; and heating to from 300 to 500° C. for from 5 seconds to 1 hour.

7. The method for producing a copper alloy sheet material according to claim 6, wherein the method does not comprise a heat treatment accompanied by reduction in electroconductivity after hot rolling.

8. A current carrying component comprising the copper alloy sheet material according to claim 1.

9. A heat dissipation component comprising the copper alloy sheet material according to claim 1.

* * * * *